US008805231B2

(12) United States Patent
Suzuki et al.

(10) Patent No.: US 8,805,231 B2
(45) Date of Patent: Aug. 12, 2014

(54) COOLING DEVICE AND IMAGE FORMING APPARATUS INCLUDING THE SAME

(75) Inventors: Shingo Suzuki, Kanagawa (JP); Satoshi Okano, Kanagawa (JP); Masanori Saitoh, Tokyo (JP); Tomoyasu Hirasawa, Kanagawa (JP); Keisuke Ikeda, Kanagawa (JP); Kenichi Takehara, Kanagawa (JP); Yasuaki Iijima, Kanagawa (JP); Hiromitsu Fujiya, Kanagawa (JP); Keisuke Yuasa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 458 days.

(21) Appl. No.: 12/929,185

(22) Filed: Jan. 6, 2011

(65) Prior Publication Data

US 2011/0188880 A1 Aug. 4, 2011

(30) Foreign Application Priority Data

Feb. 4, 2010 (JP) ..... 2010-022728
Oct. 7, 2010 (JP) ..... 2010-227212

(51) Int. Cl.
*G03G 21/20* (2006.01)

(52) U.S. Cl.
USPC ..... 399/94

(58) Field of Classification Search
USPC ..... 399/94
See application file for complete search history.

(56) References Cited

U.S. PATENT DOCUMENTS 7,224,921 B2 5/2007 Iijima et al.
7,356,277 B2 4/2008 Iijima et al.
2005/0238380 A1 10/2005 Iijima et al.
2006/0110172 A1 5/2006 Iijima et al.
2009/0269099 A1 10/2009 Takehara
2010/0008694 A1 1/2010 Okano et al.
2010/0008695 A1 1/2010 Okano et al.
2010/0226095 A1* 9/2010 Mimura et al. ..... 361/707
2011/0030927 A1 2/2011 Okano et al.

FOREIGN PATENT DOCUMENTS

CN 101625540 1/2010
EP 2 144 125 1/2010
JP 06-038460 2/1994

(Continued)

OTHER PUBLICATIONS

European Search Report dated May 30, 2011 issued in corresponding European Application No. 111501474.4.
Office Action dated Apr. 18, 2012 issued in corresponding Chinese Application No. 201110033660.6 and English translation thereof.

(Continued)

*Primary Examiner* — David Gray
*Assistant Examiner* — Andrew Do
(74) *Attorney, Agent, or Firm* — Harness, Dickey & Pierce, P.L.C.

(57) ABSTRACT

Of a cooling device that is for use in an image forming apparatus and that includes: a heat receiving unit that receives heat from a cooling target and that is disposed to come into and away from contact with the cooling target; a heat radiating unit that radiates the heat received by the heat receiving unit; a heat conductive member disposed on at least one of a surface of the heat receiving unit on the side facing the cooling target and a surface of the cooling target on the side facing the heat receiving unit; and a protection member that is disposed on the heat conductive member to protect the heat conductive member, the protection member is substantially incompatible with binder resin of toner for use in the image forming apparatus.

20 Claims, 4 Drawing Sheets

(56) References Cited

FOREIGN PATENT DOCUMENTS

| | | | |
|---|---|---|---|
| JP | 2005-116839 | | 4/2005 |
| JP | 2008-159995 | A | 7/2008 |
| JP | 2008277684 | A | 11/2008 |

OTHER PUBLICATIONS

Japanese Office Action dated Apr. 18, 2014 for corresponding Japanese Application No. 2010-227212.

* cited by examiner

COOLING DEVICE AND IMAGE FORMING APPARATUS INCLUDING THE SAME

CROSS-REFERENCE TO RELATED APPLICATIONS

The present application claims priority to and incorporates by reference the entire contents of Japanese Patent Application No. 2010-022728 filed in Japan on Feb. 4, 2010 and Japanese Patent Application No. 2010-227212 filed in Japan on Oct. 7, 2010.

BACKGROUND OF THE INVENTION

1. Field of the Invention

The present invention relates generally to a cooling device for use in an image forming apparatus, such as a printer, a facsimile, and a copying machine, and to an image forming apparatus that includes the cooling device.

2. Description of the Related Art

It is known that in a typical image forming apparatus, devices, such as an optical writing device, fixing device, or a developing device, provided in the image forming apparatus produce heat and increase the temperature in the devices.

For instance, in the developing device, when a developer-agitating-and-conveying member that agitates and conveys a developer in the developing device is driven, frictional heat produced by friction between the developer-agitating-and-conveying member and the developer and friction among developing agent particles increases the temperature in the device. In addition, frictional heat produced by friction between the developer and a developer regulating member that regulates the thickness of the developer applied onto a developer carrier prior to conveyance of the developer to a developing area and frictional heat produced by friction among developer particles when the developer is subjected to regulation performed by the developer regulating member increase the temperature in the developing device.

The rise in temperature can fuse toner, causing the toner to stick to the developer regulating member, the developer carrier, the image carrier, and the like; this can result in a defective image, such as a streaked image. Even when the toner is not heated to a temperature at which the toner is fused, application of a pressure, friction, or the like stress to the toner can cause surface additive on the surface of the toner to be embedded into the toner or come off from the surface of the toner; this can disadvantageously cause toner component to stick to surfaces of carrier particles. Due to the disadvantage, developing performance can become less reliable from a long-term viewpoint. In particular, when toner of relatively low fusing temperature is used in order to reduce energy required for image fixation, as is often in recent years, defective image is more likely to be produced because of sticking of the toner.

Image forming apparatus that includes, to overcome such a disadvantage, a cooling device of an air cooling type that conveys air taken in from the outside by an air-cooling fan to an area around a developing device through a duct and produces an air flow that cools the developing device to thereby prevent excessive rise in temperature in the developing device has conventionally been known. However, in recent years, less and less extra space is left around a developing device because packaging inside image forming apparatuses is becoming denser because of recent compact design. This has made it difficult to find space for arranging a duct for conveying flow of air taken in by the air-cooling fan to an area around a developing device. Hence, it has become difficult to perform forced-air cooling of the developing device.

An image forming apparatus that includes a cooling device of a liquid cooling type that cools a developing device by circulating liquid is disclosed in Japanese Patent Laid-open Publication No. 2008-277684. The cooling device of the liquid cooling type includes: a heat receiving unit arranged in contact with a wall surface of the developing device and in which coolant receives heat from the developing device; a heat radiating unit for radiating the heat from the coolant; a circulating pipe that is arranged such that the coolant circulates through the heat receiving unit and the heat radiating unit; and a conveying unit that conveys the coolant in the circulating pipe. The cooling device of the liquid cooling type is capable of cooling more efficiently than an air-cooling cooling device, and hence capable of cooling the developing device efficiently. The circulating pipe can be arranged around a developing device even when space around the developing device is relatively small because cross-sectional profile of the circulating pipe, thorough which coolant circulates, is smaller than that of a duct. Thus, the cooling device is capable of cooling a developing device even when packaging inside an image forming apparatus is dense.

The image forming apparatus disclosed in Japanese Patent Laid-open Publication No. 2008-277684 includes a heat conductive member for improving heat conduction from the developing device to the heat receiving unit so that heat is conducted from the developing device to the heat receiving unit through the heat conductive member. The developing device is detachably attached to the image forming apparatus. The heat receiving unit is to be separated from the developing device when the developing device is detached from the image forming apparatus, whereas the heat receiving unit is to be brought into contact with the developing device when the developing device is attached to a main body of the image forming apparatus. To protect the heat conductive member from being peeled off or torn due to repeated contacts between the heat receiving unit and the developing device, a protection member that protects the heat conductive member is disposed on the heat conductive member.

There can be cases where separating the heat receiving unit from an object to be cooled (hereinafter, "cooling target") externally exposes a surface of the protection member to the outside, causing toner having been scattered in the image forming apparatus to stick to the surface of the protection member. In this case, binder resin of the toner may be bonded to the protection member which is compatible with the binder toner in a compatible state, which can degrade the protection member, thereby degrading capability of the protection member to protect the heat conductive member.

The present invention has been conceived in view of the above circumstance and aims at providing a cooling device capable of retarding degradation of a protection member resulting from sticking of toner to the protection member, thereby maintaining capability of the protection member to protect a heat conductive member and an image forming apparatus that includes the cooling device.

SUMMARY OF THE INVENTION

It is an object of the present invention to at least partially solve the problems in the conventional technology.

According to one aspect of the present invention, a cooling device for use in an image forming apparatus that uses toner includes a heat receiving unit that receives heat from a cooling target, the heat receiving unit being disposed to come into and away from contact with the cooling target, a heat radiating unit that radiates the heat received by the heat receiving unit, a heat conductive member that is disposed on at least one of a surface of the heat receiving unit on a side facing the cooling target and a surface of the cooling target on a side facing the heat receiving unit, and a protection member that is disposed on the heat conductive member to protect the heat conductive member, wherein the protection member is substantially incompatible with binder resin of the toner.

According to another aspect of the present invention, an image forming apparatus includes an image carrier, a latent-image forming unit that selectively forms a latent image on the image carrier according to image signal, a developing unit that develops the latent image formed on the image carrier with toner, and a cooling unit that cools at least any one of the latent-image forming unit and the developing unit, wherein the cooling unit is the cooling device according to one aspect of the present invention.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 2:
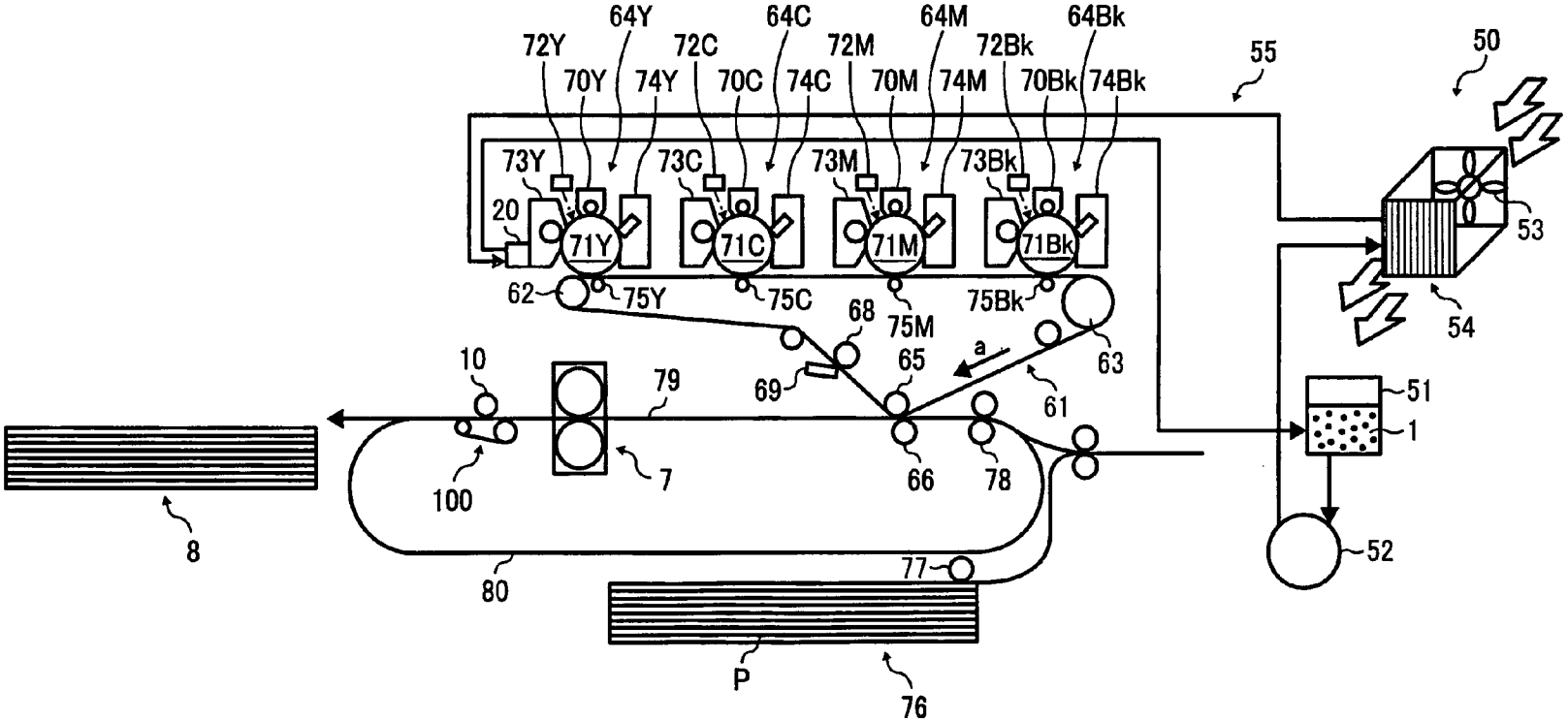
FIG. 2 is a schematic configuration diagram of an image forming apparatus according to an embodiment of the present invention.

Exemplary embodiments, in which the present invention is applied to an electrophotographic image forming apparatus, are described below with reference to the accompanying drawings. FIG. 2 is a schematic configuration diagram of a color tandem image forming apparatus that includes an intermediate transfer belt according to an embodiment of the present invention.

The image forming apparatus includes an intermediate transfer belt 61, which is an intermediate transfer medium, supported on a plurality of rollers and configured to be rotated by the rollers, and processing units for image forming arranged around the intermediate transfer belt 61.

The intermediate transfer belt 61 is assumed to rotate in a rotating direction indicated by arrow "a" in FIG. 2. At a position above the intermediate transfer belt 61 and between a roller 62 and a roller 63, a first image station 64Y, a second image station 64C, a third image station 64M, a fourth image station 64Bk that correspond to the units for image forming processing are arranged in this order from upstream relative to the rotating direction of the intermediate transfer belt 61. For instance, the first image station 64Y includes an electrostatic charging unit 70Y, an optical writing device 72Y, a developing device 73Y, and a cleaning unit 74Y that are arranged around a drum-like photosensitive member 71Y. The first image station 64Y further includes a primary transfer roller 75Y, which corresponds to a transfer unit that performs transfer to the intermediate transfer belt 61, at a position facing the photosensitive member 71Y across the intermediate transfer belt 61. The other three image stations are each identical to the first image station 64Y in structure. These four image stations are laterally aligned so as to have regular intervals from each other.

Although an optical system that uses a light-emitting diode (LED) as a light source is employed as the optical writing device 72Y/72C/72M/72Bk in the embodiment, a laser optical system that uses a semiconductor laser as a light source can alternatively employed as the optical writing device 72Y/72C/72M/72Bk. The optical writing device 72Y/72C/72M/72Bk performs exposure of the photosensitive member 71Y/71C/71M/71Bk according to image information.

Below the intermediate transfer belt 61 disposed are a paper bin 76 for paper P, which is a sheet-type member, a paper feed roller 77, a pair of registration rollers 78, a roller 65 that supports the intermediate transfer belt 61, a secondary transfer roller 66 that opposes the roller 65 across the intermediate transfer belt 61 and corresponds to a transfer unit that performs transfer from the intermediate transfer belt 61 to the paper P, a roller 68 that is in contact with back surface of the intermediate transfer belt 61, a cleaning unit 69 that is disposed at a position facing the roller 68 so as to come into contact with front surface of the intermediate transfer belt 61, a fixing device 7, a cooling device 100 that includes a cooling roller 10 that cools the paper P, and an output-paper bin 8, on which the paper P having undergone toner fixation is to be delivered. A paper conveying path 79 extends from the paper bin 76 to the output-paper bin 8. The image forming apparatus also includes a paper conveying path 80 for use in duplex image forming. The paper conveying path 80 reverses the paper P that has passed through the cooling device 100 once and conveys the paper P to the pair of registration rollers 78 again so that an image is formed on the backside of the paper P in duplex image forming.

Image forming process performed by, for instance, the first image station 64Y is a general electrostatic recording method. The photosensitive member 71Y is uniformly electrostatically charged by the electrostatic charging unit 70Y in the dark and then subjected to exposure performed by the optical writing device 72Y that forms an electrostatic latent image on the photosensitive member 71Y. This electrostatic latent image is developed by the developing device 73Y into a visible, toner image. The toner image is transferred from the photosensitive member 71Y onto the intermediate transfer belt 61 via the primary transfer roller 75Y. The surface of the photosensitive member 71Y, from which the toner image has been transferred, is cleaned by the cleaning unit 74Y. The other three image stations 64C/64M/64Bk are each identical to the first image station 64Y in structure; and, an image forming process similar to that described above is performed in each of the image stations 64C/64M/64Bk.

The developing devices 73Y, 73C, 73M and 73Bk in the image stations 64Y, 64C, 64M, and 64Bk perform development with toner of four different colors. The toner can be toner that contains polyester resin as major constituent of binder resin or toner that contains styrene-acrylic resin as major constituent of binder resin. By allotting yellow, cyan, magenta, and black to image stations 64Y, 64C, 64M, and 64Bk, respectively, a full-color image can be formed. More specifically, over the course where a single, same image forming area on the intermediate transfer belt 61 passes sequentially through the image stations 64Y, 64C, 64M, and 64Bk, toner images are transferred one color by one color onto the intermediate transfer belt 61 to be overlaid on one another by application of transfer bias from the primary transfer rollers 75, each of which is arranged to face a corresponding one of the photosensitive members 71Y/71C/71M/71Bk with the intermediate transfer belt 61 therebetween. At a point in time where the single image-forming area has passed through the image stations 64Y, 64C, 64M, and 64Bk once, a full-color image has been formed on the single image-forming area by the overlaying transfer.

A heat receiving unit 20 of a cooling device 50 receives heat from the developing device 73Y. The cooling device 50 includes a radiator 54, to which a cooling fan 53 is attached, a pump 52, and a tank 51 that are communicably connected together through a liquid feed tube 55 to the heat receiving unit 20. Coolant 1 is sealed in the cooling device 50. A circulation path of the coolant 1 is described below. As illustrated by arrows appended to the liquid feed tube 55 in FIG. 2, the coolant 1 cooled in the radiator 54 is fed to the heat receiving unit 20. After passing through the heat receiving unit 20, the coolant 1 is fed to the tank 51, then to the pump 52, and returned to the radiator 54. The coolant 1 receives pump pressure from the pump 52 to thus be circulated. The coolant 1 and accordingly the heat receiving unit 20 are cooled by heat radiation in the radiator 54. The pumping power of the pump 52, the size of the radiator 54, and the like are to be selected based on flow rate, pressure, cooling efficiency, and the like that depend on conditions for thermal design (conditions concerning quantity of heat to be cooled by the heat receiving unit 20 and temperature).

The heat receiving unit 20 is illustrated as being disposed only at the developing device 73Y in FIG. 2 for simplicity; however, the heat receiving unit 20 is disposed at each of the developing devices 73Y, 73C, 73M, and 73Bk. The coolant 1 circulates through the circulation path, in which the coolant 1 pumped out from the pump 52 flows through these four heat receiving units 20 provided at the developing devices 73Y, 73C, 73M, and 73Bk in this order and then returns to the tank 51.

Temperature increase of the developing devices 73Y, 73C, 73M, and 73Bk is reduced by the cooling device 50 as described above to prevent fusing and sticking of toner, thereby preventing degradation in image quality.

The coolant target to be brought into contact with the heat receiving unit 20 of the cooling device 50 is not limited to the developing device 73 but can be the optical writing device 72, the fixing device 7, and the like that can cause the temperature in the image forming apparatus to increase. Temperature increase in the image forming apparatus can be reduced by bringing those device into contact with the heat receiving unit 20 of the cooling device 50 to cool the devices.

The full-color toner image formed on the intermediate transfer belt 61 is transferred onto the paper P. The intermediate transfer belt 61, from which the full-color toner image has been transferred, is cleaned by the cleaning unit 69. Transfer onto the paper P is performed by applying a transfer bias to the secondary transfer roller 66 that is on the roller 65 with the intermediate transfer belt 61 therebetween and causing the paper P to pass through a nip between the secondary transfer roller 66 and the intermediate transfer belt 61. After the full-color toner image has been transferred onto the paper P, the full-color toner image on the paper P is subjected to fixation performed by the fixing device 7. Hence, a full-color image, which is a finished image, has been formed on the paper P, which is then loaded on the output-paper bin 8.

Figure 3:
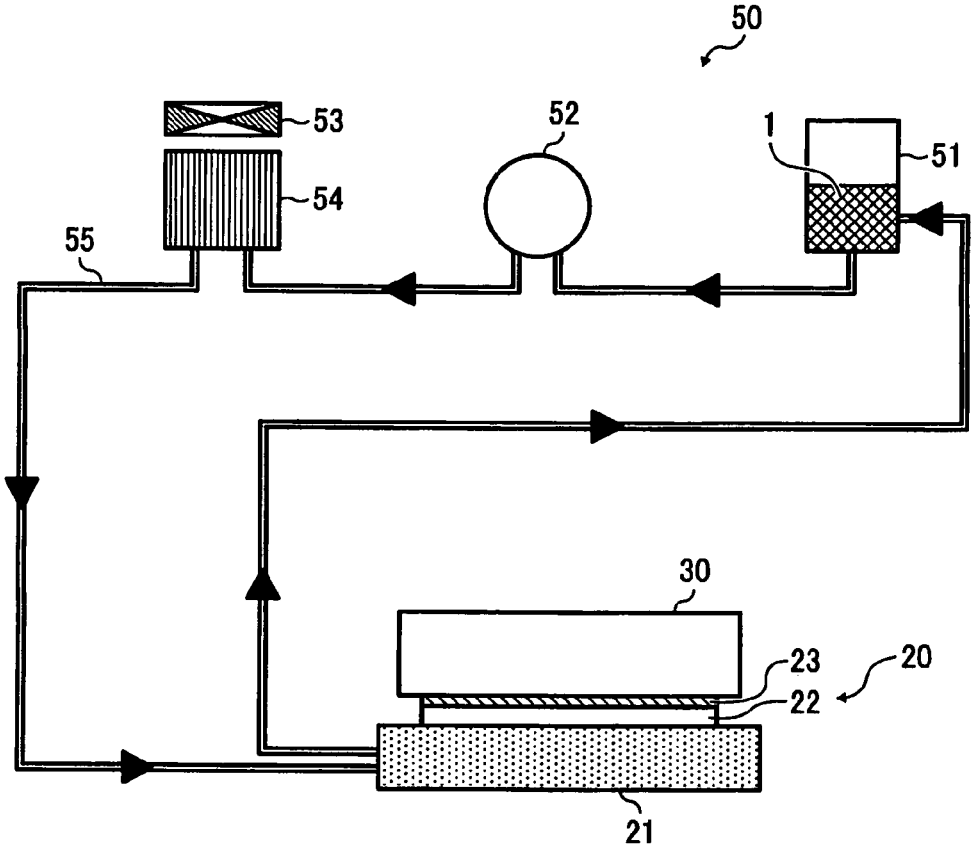
FIG. 3 is a schematic diagram of the cooling device of a liquid cooling type.

The cooling device 50 of the liquid-cooling type will be described with reference to FIG. 3. The cooling device 50 illustrated in FIG. 3 pumps out the coolant 1 from the tank 51. When passing through the radiator 54, which corresponds to a radiating unit, the coolant 1 receives an air flow produced by the cooling fan 53 and radiates heat to the outside of the coolant 1. The temperature of the coolant 1 is lowered by heat exchange between the coolant 1 and the outside.

The coolant 1 cooled in the radiator 54 is fed into a cooling unit 21 through the liquid feed tube 55 via a filler port provided at one end of the cooling unit 21 to flow through the cooling unit 21. While the coolant 1 is flowing, the cooling unit 21 carries out heat from a cooling target 30 heated to relatively high temperature via a heat conductive layer 22 and a surface-protecting-sheet layer 23. As a result of this heat exchange between the coolant 1 and the cooling target 30, the temperature of the coolant 1 in the cooling unit 21, increases.

The coolant 1 whose temperature has been increased in the cooling unit 21 is drained from the cooling unit 21 through a drain outlet of the cooling unit 21. The coolant 1 is then pumped out by the pump 52 again via the tank 51. Heat is repeatedly radiated from the cooling target 30 to the outside of the cooling device 50 by the circulation of the coolant 1.

First Exemplary Configuration

Figure 1A:
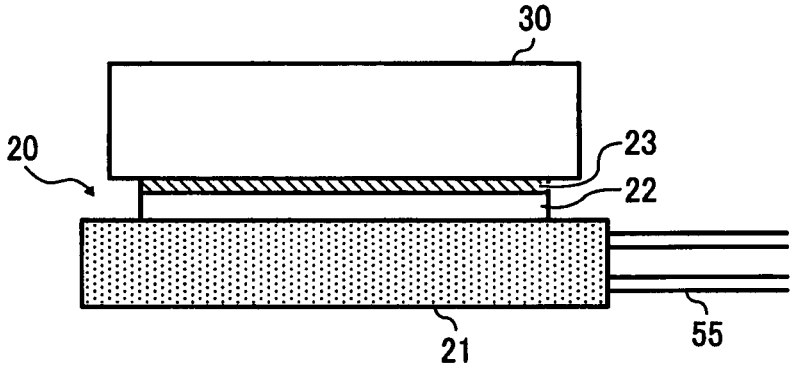
FIG. 1A is a schematic configuration diagram of a heat receiving unit of a cooling device of a first exemplary configuration of the present invention.
Figure 1B:
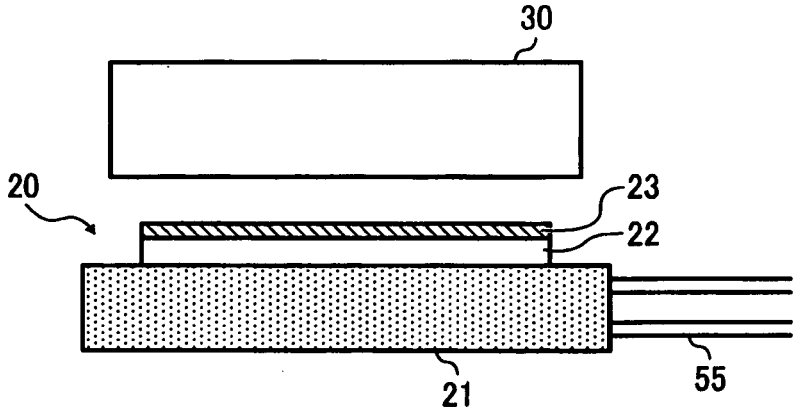
FIG. 1B is a schematic configuration diagram of the heat receiving unit in a situation where a surface-protecting-sheet layer is separated from a cooling target.

A cooling device according to a first exemplary configuration will be described with reference to FIG. 1A and FIG. 1B. FIG. 1A and FIG. 1B are schematic cross-sectional views of the configuration of a heat receiving unit of a cooling device according to the first exemplary configuration of the present invention.

With reference to FIG. 1A, the heat receiving unit 20 includes the heat conductive layer 22 that has relatively high thermal conductivity to conduct heat from the cooling target 30 to a heat receiving surface of the cooling unit 21. The heat receiving unit 20 further includes, on the heat conductive layer 22, the surface-protecting-sheet layer 23 that is substantially incompatible with binder resin of toner. The heat receiving unit 20 is made of metal, such as aluminum or copper, for efficient heat receiving. Such metal as described above generally has relatively high hardness and therefore is less easily brought into close contact with a cooling target. By arranging the heat conductive layer 22 of relatively low hardness, it is allowed to bring the heat receiving unit 20 into closer contact with the cooling target for efficient heat conduction.

The heat conductive layer 22 with heat conductivity of 1 watt per meter Kelvin (W/m·K) is preferably employed for efficient heat conduction.

A polyimide film that is substantially incompatible with the binder resin of the toner and of 30 micrometers (μm) thick is employed as the surface-protecting-sheet layer 23. Provision of the surface-protecting-sheet layer 23 enhances releasability at the detachment of the cooling target 30 from the heat receiving unit 20 and further prevents peel-off or tear of the heat conductive layer 22, which is tacky, thereby increasing durability. The polyimide film, which can be substantially compatible with the binder resin of the toner when the polyimide film contains a surface additive or the like that imparts plasticity, used as the surface-protecting-sheet layer 23 is desirably substantially incompatible with the binder resin of the toner.

As the thickness of the surface-protecting-sheet layer 23 increases, thermal conductivity of the surface-protecting-sheet layer 23 decreases, thereby decreasing cooling efficiency. In contrast, as the thickness of the surface-protecting-sheet layer 23 decreases, durability of the surface-protecting-sheet layer 23 decreases, causing the surface-protecting-sheet layer 23 to be peeled off or torn when the heat receiving unit 20 is repeatedly brought into contact with the cooling target 30. When the surface-protecting-sheet layer 23 is placed onto the heat conductive layer 22 or when the heat receiving unit 20 is repeatedly brought into contact with the cooling target 30, the surface-protecting-sheet layer 23 can be wrinkled or folded. In consideration of durability and heat conductivity, the thickness of the surface-protecting-sheet layer 23 preferably falls in an approximate range of 10 μm to 50 μm.

As illustrated in FIG. 1B, the heat receiving unit 20 and the cooling target 30 are separated from each other between the surface-protecting-sheet layer 23 and the cooling target 30. In the configuration illustrated in FIG. 1A, the heat conductive layer 22 and the surface-protecting-sheet layer 23 are disposed on the surface of the heat receiving unit 20 on the side facing the cooling target 30; however, the heat conductive layer 22 and the surface-protecting-sheet layer 23 can alternatively be disposed on the surface of the cooling target 30 on the side facing the heat receiving unit 20, or further alternatively, on each of the surface of the heat receiving unit 20 on the side facing the cooling target 30 and the surface of the cooling target 30 on the side facing the heat receiving unit 20.

There can be cases where scattered toner and dust stick to the surface of the surface-protecting-sheet layer 23 that is externally exposed by separation of the heat receiving unit 20 from the cooling target 30. If the dust and the toner stick only to the surface of the surface-protecting-sheet layer 23, the dust and the toner can be removed by a cleaning method, such as brush cleaning, vacuum cleaning, or wiping with cleaning agent, from the surface of the surface-protecting-sheet layer 23. However, when the surface-protecting-sheet layer 23 contains a component that imparts plasticity, binder resin of the toner may blend into the surface-protecting-sheet layer 23 in a compatible state, making it difficult to remove the dust and the toner. In such a condition, the surface-protecting-sheet layer 23 can be further degraded, causing the toner to stick also to the heat conductive layer 22 and the binder resin of the toner may blend into the heat conductive layer 22 in a compatible state. This results in a decrease in cooling efficiency. This can further cause the heat conductive layer 22 and the surface-protecting-sheet layer 23 to be degraded and broken.

The inventors of the present invention made the toner stick to an outermost surface of each of the heat receiving units 20 that differ from each other in conditions concerning the surface-protecting-sheet layer 23, and observed the post-storage state, observations of which are presented in Table 1.

TABLE 1

| | | First condition | Second condition | Third condition |
|---|---|---|---|---|
| Layer configuration of heat receiving unit | Heat conductive layer | Acrylic heat radiating material | Acrylic heat radiating material | Acrylic heat radiating material |
| | Surface-protecting-Sheet layer | None | Olefinic tape | Polyimide film |
| Binder resin of toner | | Polyester resin | Polyester resin | Polyester resin |
| Compatibility of surface-protecting-sheet layer with binder resin of toner | | No good (compatibile) | No good (compatibile) | Good (incompatibile) |

The heat receiving unit 20 of a first condition includes the heat conductive layer 22 adhered onto the cooling unit 21 but, does not include the surface-protecting-sheet layer 23. As the heat conductive layer 22, an acrylic heat-radiating material was used. As the toner, toner that contained polyester resin as major constituent of binder resin was used. The inventors made the toner stick to the heat conductive layer 22, which was the outermost layer of the heat receiving unit 20 in the first condition, and observed a state of the toner after leaving the toner as it was. The observations were that there were few visible toner particles, and the binder resin of the toner blended into the heat conductive layer 22 in a compatible state.

The heat receiving unit 20 of a second condition includes the heat conductive layer 22 adhered onto the cooling unit 21 and further includes the surface-protecting-sheet layer 23 provided on the heat conductive layer 22. As the heat conductive layer 22, an acrylic heat radiating material was used. As the surface-protecting-sheet layer 23, an olefinic tape was used. The surface-protecting-sheet layer 23 was adhered to the heat conductive layer 22 with an acrylic adhesive. As the toner, toner that contained polyester resin as major constituent of binder resin was used. The inventors made the toner stick to the surface-protecting-sheet layer 23, which was the outermost layer of the heat receiving unit 20 in the second condition, and observed a state of the toner after leaving the toner as it was. As with the first condition, the observations were that there were few visible particles and the binder resin of the toner substantially blended into the surface-protecting-sheet layer 23 in a compatible state. Although an attempt of removing the toner from the surface-protecting-sheet layer 23 was made by performing a cleaning method, such as brush cleaning, vacuum cleaning, and wiping with cleaning agent, the attempt ended in failure because the toner was firmly sticking to the surface-protecting-sheet layer 23.

The heat receiving unit 20 of a third condition includes, as in the second condition, the heat conductive layer 22 adhered onto the cooling unit 21 and further includes the surface-protecting-sheet layer 23 provided on the heat conductive layer 22. As the heat conductive layer 22, an acrylic heat radiating material was used. As the surface-protecting-sheet layer 23, a polyimide film of 30 μthick was used. The surface-protecting-sheet layer 23 was adhered to the heat conductive layer 22 with an acrylic adhesive. As the toner, toner that contained polyester resin as major constituent of binder resin was used. The inventors made the toner stick to the surface-protecting-sheet layer 23, which was the outermost layer of the heat receiving unit 20 in the third condition, and observed a state of the toner after leaving the toner as it was. The observations were that the toner remained in a state of particles as was before the toner was left. An attempt of removing the toner from the surface-protecting-sheet layer 23 was made by performing a cleaning method, such as brush cleaning, vacuum cleaning, and wiping with cleaning agent. With any one of the methods, the toner was successfully and easily removed from the surface-protecting-sheet layer 23.

Although an acrylic heat radiating material is employed as the heat conductive layer 22 in the first exemplary configuration, other material, such as silicone material, can alternatively be employed.

Second Exemplary Configuration

Figure 4:
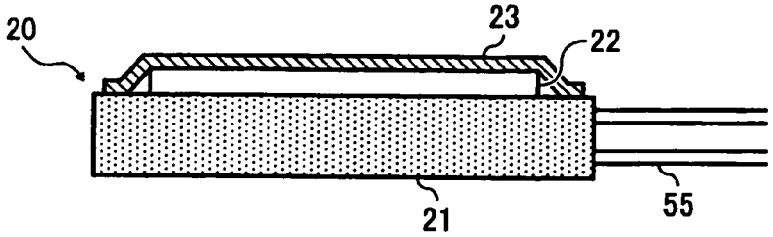
FIG. 4 is a schematic configuration diagram of a heat receiving unit of a cooling device according to a second exemplary configuration.

A cooling device according to a second exemplary configuration will be described with reference to FIG. 1A, FIG. 1B, and FIG. 4. FIG. 4 is a schematic cross-sectional view of the configuration of the heat receiving unit 20 of the cooling device according to the second exemplary configuration of the present invention.

With reference to FIG. 4, the heat receiving unit 20 includes the heat conductive layer 22 that has relatively high thermal conductivity to conduct heat from the cooling target 30 to the heat receiving surface of the cooling unit 21. The heat receiving unit 20 further includes, on the heat conductive layer 22, the surface-protecting-sheet layer 23 that is substantially incompatible with binder resin of toner. A polyimide film that is substantially incompatible with the binder resin of the toner and of 30 μm thick is employed as the surface-protecting-sheet layer 23.

As can be seen from FIG. 4, the surface-protecting-sheet layer 23, of which surface area is larger than that of the heat conductive layer 22, is disposed on the heat conductive layer 22 so as to cover the heat conductive layer 22; a rim portion of and around the surface-protecting-sheet layer 23 is directly affixed to the heat receiving surface of the cooling unit 21. This prevents end surfaces of the heat conductive layer 22 from being externally exposed because the surface-protecting-sheet layer 23 protects the end surfaces. Accordingly, even when toner is scattered, toner is prevented from sticking to the end surfaces of the surface-protecting-sheet layer 23.

Other structure and function of the heat receiving unit 20 of the second exemplary configuration are similar to those of the first exemplary configuration, and the descriptions thereof are not repeated.

The inventors of the present invention made toner stick to portions around the end surfaces of the heat conductive layer 22 of the configuration illustrated in FIG. 1A and FIG. 1B, and observed the post-storage states. The heat receiving unit 20 used at this time includes the heat conductive layer 22 adhered onto the cooling unit 21 and further includes the surface-protecting-sheet layer 23 provided on the heat conductive layer 22. As the heat conductive layer 22, an acrylic heat radiating material was used. As the surface-protecting-sheet layer 23, a polyimide film of 30 μm thick was used. The surface-protecting-sheet layer 23 was adhered to the heat conductive layer 22 with an acrylic adhesive. As the toner, toner that contained polyester resin as major constituent of binder resin was used. The inventors made the toner stick to the portions around the end surfaces of the heat conductive layer 22 and observed a state of the toner after leaving the toner as it was. The observations were that the toner was sticking to the end surfaces of the heat conductive layer 22 in a compatible state. When the heat receiving unit 20 in such a state was brought into contact with the cooling target 30 repeatedly, the end surface of the heat conductive layer 22 was chipped. When repeated further, a portion of the heat conductive layer 22 and/or the surface-protecting-sheet layer 23 around the end surface was chipped.

In contrast, with the configuration illustrated in FIG. 4, toner is prevented from sticking to the end surfaces of the heat conductive layer 22. Accordingly, degradation of the heat conductive layer 22 and the surface-protecting-sheet layer 23 that can result from blending of the binder resin of the toner into the end surface of the heat conductive layer 22 in a compatible state as described above can be retarded. However, when the heat receiving unit 20 is used for a long period of time, the rim portion of the surface-protecting-sheet layer 23 affixed to the cooling unit 21 can come off. Hence, it is desirable to retain the rim portion by pressing the rim portion against the cooling unit 21.

Third Exemplary Configuration

Figure 5:
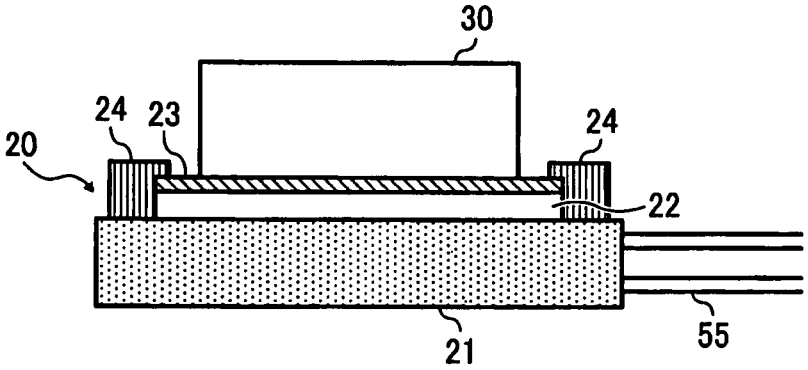
FIG. 5 is a schematic configuration diagram of a heat receiving unit of a cooling device according to a third exemplary configuration.

A cooling device according to a third exemplary configuration will be described with reference to FIG. 1A, FIG. 1B, and FIG. 5. FIG. 5 is a schematic cross-sectional view of the configuration of the heat receiving unit 20 of the cooling device according to the third exemplary configuration of the present invention.

With reference to FIG. 5, the heat receiving unit 20 includes the heat conductive layer 22 that has relatively high thermal conductivity to conduct heat from the cooling target 30 to the heat receiving surface of the cooling unit 21. The heat receiving unit 20 further includes, on the heat conductive layer 22, the surface-protecting-sheet layer 23 that is substantially incompatible with binder resin of the toner. A polyimide film that is substantially incompatible with the binder resin of the toner and of 30 μm thick is employed as the surface-protecting-sheet layer 23. The surface-protecting-sheet layer 23 is adhered to the heat conductive layer 22 with an acrylic adhesive.

In addition, an end-surface protection member 24 is disposed on the heat receiving surface of the cooling unit 21 such that the end-surface protection member 24 surrounds the end surfaces of the heat conductive layer 22 and the surface-protecting-sheet layer 23 while being in contact therewith. This prevents, even when toner is scattered, the toner from sticking to the end surfaces of the heat conductive layer 22 and the surface-protecting-sheet layer 23 that are protected by the end-surface protection member 24 from being externally exposed.

Other structure and function of the heat receiving unit 20 of the third exemplary configuration are similar to those of the first exemplary configuration, and the same description are not repeated.

Fourth Exemplary Configuration

Figure 6:
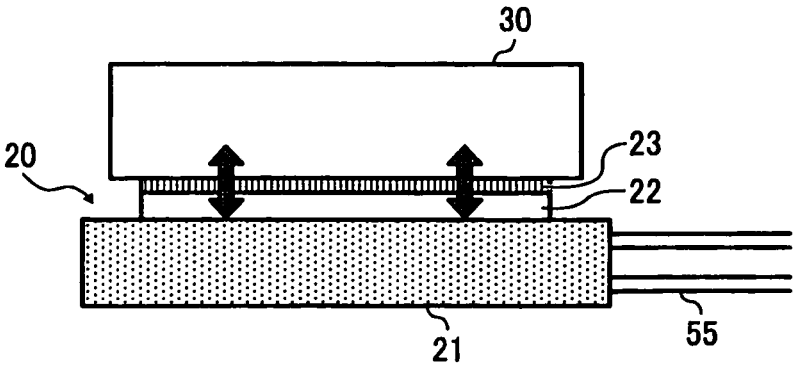
FIG. 6 is a schematic configuration diagram of a heat receiving unit of a cooling device according to a fourth exemplary configuration.

A cooling device according to a fourth exemplary configuration will be described with reference to FIG. 1A, FIG. 1B, and FIG. 6. FIG. 6 is a schematic cross-sectional view of the configuration of the heat receiving unit 20 of the cooling device according to the fourth exemplary configuration of the present invention.

With reference to FIG. 1A and FIG. 1B, the heat receiving unit 20 includes the heat conductive layer 22 that has relatively high thermal conductivity to conduct heat from the cooling target 30 to the heat receiving surface of the cooling unit 21. The heat receiving unit 20 further includes, on the heat conductive layer 22, a surface-protecting-sheet layer 23 that is substantially incompatible with binder resin of the toner.

A polyethylene terephthalate (PET) film that is substantially incompatible with the binder resin of the toner and of 50 μm thick is employed as the surface-protecting-sheet layer 23. Provision of the surface-protecting-sheet layer 23 enhances releasability of the heat receiving unit 20 at detachment from the cooling target 30 and further prevents peel-off or tear of the heat conductive layer 22, which is tacky, thereby increasing durability. The PET film needs to be substantially incompatible with the binder resin of the toner, and attention should be paid so that the additive or the like that imparts plasticity would not impair the incompatibility. Using the PET film as the surface-protecting-sheet layer 23 can lead to cost reduction.

As the thickness of the surface-protecting-sheet layer 23 increases, thermal conductivity of the surface-protecting-sheet layer 23 decreases, thereby decreasing cooling efficiency. In contrast, as the thickness of the surface-protecting-sheet layer 23 decreases, durability of the surface-protecting-sheet layer 23 decreases, causing the surface-protecting-sheet layer 23 to be peeled off or torn when the heat receiving unit 20 is repeatedly brought into contact with the cooling target 30. When the surface protecting-sheet layer 23 is placed onto the heat conductive layer 22 or when the heat receiving unit 20 is repeatedly brought into contact with the cooling target 30, the surface-protecting-sheet layer 23 can be wrinkled or folded. In consideration of durability and heat conductivity, the thickness of the surface-protecting-sheet layer 23 preferably falls in an approximate range of 10 μm to 50 μm.

Other structure and function of the fourth exemplary configuration are similar to those of the first exemplary configuration, and the same descriptions are not repeated.

The inventors of the present invention made toner stick to an outermost surface of each of the heat receiving units 20 that differ from each other in conditions concerning the surface-protecting-sheet layer 23 and the binder resin of the toner, and observed the post-storage state, observations of which are presented in Table 2.

TABLE 2

| | | Fourth condition | Fifth condition | Sixth condition | Seventh condition |
|---|---|---|---|---|---|
| Layer configuration of heat receiving unit | Heat conductive layer | Acrylic heat radiating material | Acrylic heat radiating material | Acrylic heat radiating material | Acrylic heat radiating material |
| | Surface-protecting-Sheet layer | Polyimide film | Polyimide film | PET film | PET film |
| Binder resin of toner | | Polyester resin | Styrene-acrylic resin | Polyester resin | Styrene-acrylic resin |
| Compatibility of surface-protecting-sheet layer with binder resin of toner | | Good (incompatibile) | Good (incompatibile) | Good (incompatibile) | Good (incompatibile) |

The heat receiving unit 20 of a fourth condition includes the heat conductive layer 22 adhered onto the cooling unit 21 and further includes the surface-protecting-sheet layer 23 provided on the heat conductive layer 22. As the heat conductive layer 22, an acrylic heat-radiating material was used. As the surface-protecting-sheet layer 23, a polyimide film of 30 μm thick was used. The surface-protecting-sheet layer 23 was adhered to the heat conductive layer 22 with an acrylic adhesive. As the toner, toner that contained polyester resin as major constituent of binder resin was used. The inventors made the toner stick to the surface-protecting-sheet layer 23, which was the outermost layer of the heat receiving unit 20 at the fourth condition, and observed a state of the toner after leaving the toner as it was. The observations were that the toner remained in a state of particles as was before the toner was left. An attempt of removing the toner from the surface-protecting-sheet layer 23 was made by performing a cleaning method, such as brush cleaning, vacuum cleaning, and wiping with cleaning agent. With any one of the methods, the toner was successfully and easily removed from the surface-protecting-sheet layer 23.

A fifth condition differs from the fourth condition only in the condition concerning the binder resin of the toner. More specifically, observations similar to those described above were made with use of toner that contained styrene-acrylic resin as major constituent of the binder resin. The observations were similar to those of the fourth condition.

The heat receiving unit 20 of a sixth condition includes, as in the fourth condition, the heat conductive layer 22 adhered onto the cooling unit 21 and further includes the surface-protecting-sheet layer 23 provided on the heat conductive layer 22. As the heat conductive layer 22, an acrylic heat-radiating material was used. As the surface-protecting-sheet layer 23, a PET film of 50 μm thick was used. The surface-protecting-sheet layer 23 was adhered to the heat conductive layer 22 with an acrylic adhesive. As the toner, toner that contained polyester resin as major constituent of binder resin was used. The inventors caused the toner to stick to the surface-protecting-sheet layer 23, which was the outermost layer of the heat receiving unit 20 at the fifth condition, and observed a state of the toner after leaving the toner as it was. The observation was that the toner remained in a state of particles as was before the toner was left. An attempt of removing the toner from the surface-protecting-sheet layer 23 was made by performing a cleaning method, such as brush cleaning, vacuum cleaning, and wiping with cleaning agent. With any one of the methods, the toner was successfully and easily removed from the surface-protecting-sheet layer 23.

A seventh condition differs from the sixth condition only in the condition concerning the binder resin of the toner. More specifically, observations similar to those described above were made with use of toner that contained styrene-acrylic resin as major constituent of the binder resin. The observations were similar to those of the sixth condition.

A polyimide film or a PET film that is substantially incompatible with the binder resin of the toner is employed as the surface-protecting-sheet layer 23 in the embodiments; however, the surface-protecting-sheet layer 23 is not limited thereto. More specifically, any sheet not containing surface additive or the like that imparts plasticity, being substantially incompatible with the binder resin of the toner, having high heat conductivity, and being endurable to repeated contact of the heat receiving unit 20 with the cooling target 30 can be employed as the surface-protecting-sheet layer 23. By using a sheet that conducts heat in a way that is anisotropic as the surface-protecting-sheet layer 23 and arranging the sheet such that heat conductivity in the direction of thickness of the sheet is larger than heat conductivity in the direction along the plane of the sheet, thermal diffusion in the direction along the plane of the surface-protecting-sheet layer 23 can be reduced. This leads to efficient heat exchange between the heat receiving unit 20 and the cooling target 30.

As described above, according to the embodiment, of the cooling device 50 that is for use in the image forming apparatus and that includes: the heat receiving unit 20 that receives heat from the cooling target 30 and that is disposed to come into and away from contact with the cooling target 30; the radiator 54 that radiates the heat received by the heat receiving unit 20; the heat conductive layer 22 disposed on at least one of the surface of the heat receiving unit 20 on the side facing the cooling target 30 and the surface of the cooling target 30 on the side facing the heat receiving unit 20; and the surface-protecting-sheet layer 23 that is disposed on the heat conductive layer 22 to protect the heat conductive layer 22, the surface-protecting-sheet layer 23 is substantially incompatible with binder resin of toner for use in the image forming apparatus. This allows degradation of the surface-protecting-sheet layer 23 resulting from blending of binder resin of toner into the surface-protecting-sheet layer 23 in a compatible state to be retarded because, even when toner sticks to the surface-protecting-sheet layer 23, the binder resin of the toner does not blend into the surface-protecting-sheet layer 23 in a compatible state. Hence, capability of the surface-protecting-sheet layer 23 to protect the heat conductive layer 22 can be maintained because degradation of the surface-protecting-sheet layer 23 is retarded. Thus, degradation of the heat conductive layer 22 can be retarded, which allows not only cooling capability of the heat receiving unit 20 of the cooing device to be maintained for a long period of time but also allows the heat conductive layer 22 to be used for a long period of time without replacement.

According to the embodiment, as the surface-protecting-sheet layer 23, a member that is incompatible with polyester resin or styrene-acrylic resin is employed. This allows, when toner that contains polyester resin as major constituent of binder resin or toner that contains styrene-acrylic resin as major constituent of binder resin is used as the toner for use in the image forming apparatus, degradation of the surface-protecting-sheet layer 23 resulting from blending of the binder resin of the toner into the surface-protecting-sheet layer 23 in a compatible state can be retarded because, even when the toner sticks to the surface-protecting-sheet layer 23, the binder resin of the toner may not be bonded to the surface-protecting-sheet layer 23 in a compatible state.

According to the embodiment, the surface-protecting-sheet layer 23 is disposed on the heat receiving unit 20 such that the surface-protecting-sheet layer 23 covers the heat conductive layer 22. This prevents toner from sticking to the end surfaces of the heat conductive layer 22, thereby retarding degradation of end portion of the heat conductive layer 22. This allows not only cooling capability of the heat receiving unit 20 of the cooing device to be maintained for a longer period of time but also allows the heat conductive layer 22 to be used for a longer period of time without replacement.

According to the embodiment, the end-surface protection member 24 that protects the end surfaces of the heat conductive layer 22 is disposed on the cooling target 30 or on the heat receiving unit 20. This prevents toner from sticking to the end surfaces of the heat conductive layer 22, thereby retarding degradation of the end portion of the heat conductive layer 22. This allows not only cooling capability of the heat receiving unit 20 of the cooing device to be maintained for a longer period of time but also allows the heat conductive layer to be used for a longer period of time without replacement.

According to the embodiment, as the surface-protecting-sheet layer 23, a PET sheet, which corresponds to a member formed from PET and which is relatively less expensive, is employed. This leads to cost reduction of the device.

According to the embodiment, the surface-protecting-sheet layer 23 is a layer, in which heat conductive fibers are oriented in a direction of thickness of the surface-protecting-sheet layer 23, that conducts heat in a way that is anisotropic. This increases capability of the heat receiving unit 20 to cool the cooling target 30 because heat can be conducted from the cooling target 30 to the heat receiving unit 20 efficiently.

According to the embodiment, the cooling device is of a liquid cooling type that includes the liquid feed tube 55, which corresponds to a coolant-circulation-path forming member, that communicably connects the heat receiving unit 20 and the radiator 54 together so that the coolant 1 can circulate through the heat receiving unit and the radiator 54 and the pump 52, which corresponds to a liquid feed unit that causes the coolant 1 to circulate. Accordingly, regional cooling in the device can be achieved because heat of the cooling target 30 in the device is received by the heat receiving unit 20, in which the coolant 1 flows, and then radiated to the outside of the device via the radiator 54. Furthermore, reduction in scattering of toner and noise can be achieved because this configuration does not include a cooling fan at a cooling portion.

According to the embodiment, in the image forming apparatus that includes: the photosensitive member 71 corresponding to an image carrier; an optical writing device 72 that selectively forms a latent image on the photosensitive member 71 according to image signal and that corresponds to the latent-image forming unit; a developing device 73 that develops the latent image formed on the photosensitive member 71 with toner and that corresponds to a developing unit; and a cooling unit that cools at least any one of the optical writing device 72 and the developing device 73, a cooling device according to an aspect of the present invention is employed This allows not only cooling capability of the heat receiving unit 20 of the cooing device to be maintained for a long period of time but also allows the heat conductive layer to be used for a long period of time without replacement. In particular, when the cooling device of a liquid cooling type is employed, regional cooling in the apparatus can be achieved because heat of the cooling target 30 in the apparatus is received by the heat receiving unit 20, in which the coolant 1 flows, and then radiated to the outside of the apparatus via the radiator 54. Furthermore, reduction in scattering of toner and noise in the image forming apparatus can be achieved because this configuration does not include a cooling fan at a cooling portion.

According to an aspect of the present invention, degradation of a protection member resulting from blending of binder resin of toner into the protection member in a compatible state can be retarded because, even when toner sticks to the protection member, the protection member and the binder resin of the toner are incompatible with each other. Hence, capability of the protective member to protect a heat conductive member can be maintained because degradation of the protection member is retarded.

As described above, there is provided an advantage of preventing the protection member from being degraded by toner sticking thereto, thereby maintaining capability of the protection member to protect the heat conductive member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cooling device for use in an image forming apparatus that uses toner, the cooling device comprising:

a heat receiving unit that receives heat from a cooling target, the heat receiving unit being disposed to come into contact with and away from the cooling target, the heat receiving unit including:

a heat receiving surface of a heat radiating unit that radiates the heat received by the heat receiving unit;

a heat conductive member that is disposed on the surface of the heat receiving unit on a side facing the cooling target; and a protection member that is disposed between the heat conductive member and the cooling target to protect the heat conductive member, wherein the protection member is substantially incompatible with binder resin of the toner, and the heat receiving surface of the heat radiating unit is in direct contact with the heat conductive member.

2. The cooling device according to claim 1, wherein the protection member is a member that is substantially incompatible with any one of polyester resin and styrene-acrylic resin.

3. The cooling device according to claim 1, wherein the protection member is disposed on the heat receiving unit such that the protection member covers the heat conductive member.

4. The cooling device according to claim 1, wherein an end-surface protection member that protects an end surface of the heat conductive member is disposed on the heat receiving unit.

5. The cooling device according to claim 1, wherein the protection member is a member formed from PET.

6. The cooling device according to claim 1, wherein the protection member is a layer, in which heat conductive fibers are oriented in a direction of thickness of the protection member, that conducts heat in a way that is anisotropic.

7. The cooling device according to claim 1, further comprising:

a coolant-circulation-path forming member that communicably connects the heat receiving unit and the heat radiating unit together to allow coolant to circulate through the heat receiving unit and the heat radiating unit; and a liquid feed unit that causes the coolant to circulate.

8. The cooling device according to claim 1, wherein the heat conductive member has a low hardness so as to bring the heat receiving unit into closer contact with the cooling target for efficient heat conduction.

9. The cooling device according to claim 1, wherein the heat conductive member is an acrylic heat radiating material.

10. The cooling device according to claim 1, wherein the protection member is adhered to the heat conductive member with an acrylic adhesive.

11. An image forming apparatus, comprising:

an image carrier;

a latent-image forming unit that selectively forms a latent image on the image carrier according to image signal;

a developing unit that develops the latent image formed on the image carrier with toner; and a cooling unit that cools at least any one of the latent-image forming unit and the developing unit, the cooling unit being a cooling device for use in an image forming apparatus that uses toner, the cooling device including:

a heat receiving unit that receives heat from a cooling target, the heat receiving unit being disposed to come into contact with and away from the cooling target, the heat receiving unit including:

a heat receiving surface of a heat radiating unit that radiates the heat received by the heat receiving unit;

a heat conductive member that is disposed on the surface of the heat receiving unit on a side facing the cooling target; and a protection member that is disposed between the heat conductive member and the cooling target to protect the heat conductive member, the protection member being substantially incompatible with binder resin of the toner, wherein the heat receiving surface of the heat radiating unit is in direct contact with the heat conductive member.

12. The image forming apparatus according to claim 11, wherein the protection member is a member that is substantially incompatible with any one of polyester resin and styrene-acrylic resin.

13. The image forming apparatus according to claim 11, wherein the protection member is disposed on the heat receiving unit such that the protection member covers the heat conductive member.

14. The image forming apparatus according to claim 11, wherein an end-surface protection member that protects an end surface of the heat conductive member is disposed on the heat receiving unit.

15. The image forming apparatus according to claim 11, wherein the protection member is a member formed from PET.

16. The image forming apparatus according to claim 11, wherein the protection member is a layer, in which heat conductive fibers are oriented in a direction of thickness of the protection member, that conducts heat in a way that is anisotropic.

17. The image forming apparatus according to claim 11, wherein the cooling unit further comprising:

a coolant-circulation-path forming member that communicably connects the heat receiving unit and the heat radiating unit together to allow coolant to circulate through the heat receiving unit and the heat radiating unit; and a liquid feed unit that causes the coolant to circulate.

18. The image forming apparatus according to claim 11, wherein the heat conductive member has a low hardness so as to bring the heat receiving unit into closer contact with the cooling target for efficient heat conduction.

19. The image forming apparatus according to claim 11, wherein the heat conductive member is an acrylic heat radiating material.

20. The image forming apparatus according to claim 11, wherein the protection member is adhered to the heat conductive member with an acrylic adhesive.

* * * * *